US005267537A

United States Patent [19]

Suzuki et al.

[11] Patent Number: 5,267,537

[45] Date of Patent: Dec. 7, 1993

[54] LUBRICATING STRUCTURE FOR POWER TRANSMISSION CHAIN

[75] Inventors: Tadasu Suzuki, Higashimurayama; Yuichi Futami, Iruma; Kazuhiko Shimaya, Hidaka; Kazuhiko Tsutsumi, Tokorozawa, all of Japan

[73] Assignee: Tsubakimoto Chain Co., Osaka, Japan

[21] Appl. No.: 998,967

[22] Filed: Dec. 28, 1992

[30] Foreign Application Priority Data

Dec. 27, 1991 [JP] Japan ..... 3-112740[U]

[51] Int. Cl.[5] ..... F01M 9/10

[52] U.S. Cl. ..... 123/90.38; 123/90.33; 123/90.31; 474/146; 184/11.5; 184/15.1

[58] Field of Search ..... 184/11.5, 15.1, 15.2, 184/15.3, 88.1; 123/90.31, 195 C, 198 E, 90.33, 90.38; 474/144, 145, 146, 147

[56] References Cited

U.S. PATENT DOCUMENTS

| | | | |
|---|---|---|---|
| 3,017,782 | 1/1962 | Wilson | 474/146 |
| 3,576,142 | 4/1971 | Matthews | 474/146 |
| 3,610,055 | 4/1970 | Parris | 474/146 |
| 3,762,643 | 10/1973 | Allen, Jr. | 184/15.1 |
| 3,939,730 | 2/1976 | DeHaan | 474/147 |
| 4,438,737 | 3/1984 | Burandt | 123/90.31 |
| 4,674,452 | 6/1987 | Asanomi | 123/90.31 |
| 5,041,062 | 8/1991 | Dornhoff | 184/15.1 |

FOREIGN PATENT DOCUMENTS

| | | | |
|---|---|---|---|
| 423917 | 5/1911 | France | 123/90.31 |
| 2311970 | 12/1976 | France | 184/15.2 |

*Primary Examiner*—Thomas E. Denion
*Attorney, Agent, or Firm*—Howson and Howson

[57] ABSTRACT

In a machine, such as an internal combustion engine, in which a chain is used to transmit rotating power from one shaft to another, the chain is situated in an oil-tight chain compartment which is separated from other lubricant containing spaces so that lubricating oil in the other spaces cannot flow directly into the lubricating oil in the chain compartment. Contamination of the chain lubricant is avoided, and the useful life of the chain is increased. In a first embodiment, a separate quantity of oil is situated in the chain compartment. In a second embodiment, the chain lubricating oil is recirculated in the chain compartment by a dedicated pump. In a third embodiment, filtered engine oil is delivered to the chain compartment through a passage in a shaft, and through a port in a chain sprocket on the shaft.

4 Claims, 2 Drawing Sheets

LUBRICATING STRUCTURE FOR POWER TRANSMISSION CHAIN

BRIEF SUMMARY OF THE INVENTION

This invention relates to the lubrication of power transmission chains, such as a timing chain, used for driving a camshaft of an engine in a motor vehicle from the engine's crankshaft. It relates more particularly to a lubricating structure wherein lubricating oil for the chain is isolated from the lubricating oil which surrounding the shafts in order to prevent contamination of the chain lubricating oil and thereby prolong the useful life of the chain.

In a conventional internal combustion engine, essential lubrication is provided by lubricating oil contained within a space defined by the engine block, the oil pan, the cam cover, and a timing chain cover. Because this lubricating space is continuous, and the oil in the space is used to lubricate all the component parts of the engine, including the crankshaft, the camshaft, the timing chain and other moving parts, the oil tends to deteriorate or become contaminated rapidly, with the result that the timing chain tends to elongate due to inadequate lubrication, and its useful life is shortened.

The principal object of this invention is to provide an improved lubricating structure for a machine in which one shaft is driven by another through a power transmission chain, in which contamination and deterioration of the chain lubricant are significantly reduced, thereby prolonging the useful life of the chain. It is also an object of the invention to provide an improved lubricating structure which reduces chain elongation. A still further object of the invention is to allow for reduction in the weight of the power transmission chain.

This invention overcomes the above-described disadvantages, and addresses the foregoing objects, by means of a lubricating structure which has an independent, oil-tight space formed for the installation of a power transmission chain. Oil is held in this space, or alternatively, supplied to this space through a circulation path including an oil filter.

Since the space for installing the power transmission chain is oil-tight, the oil used to lubricate the chain can be applied only to the chain, and, as it is not used for the lubrication of other component parts, it will not deteriorate by reason of contamination by oil used to lubricate these other component parts.

Alternatively, even where the same oil which lubricates other component parts is used to lubricate the chain, the invention prevents the oil from flowing directly from the spaces, e.g. the oil pan and cam cover, surrounding these other parts to the chain enclosure, and allows the oil to be filtered before it enters the chain enclosure.

In the preferred embodiment of the invention, a machine having at least two rotatable shafts, and means, comprising a chain, for transmitting rotating power from one of said shafts to the other, and in which a part of each of said shafts extends through a space containing a lubricating oil, includes means providing an enclosure surrounding the chain, said enclosure being capable of containing a lubricating oil, and sealing means for preventing direct flow of lubricating oil from each said space into the interior of said enclosure, whereby contamination of lubricating oil in said enclosure is prevented.

In the case of an internal combustion engine having an oil pan, a crankshaft located at least in part within a crankshaft space located above an oil pan, a cam cover, a camshaft located at least in part within a camshaft space enclosed at least in part by said cam cover, means comprising a power transmission chain connecting the crankshaft to the camshaft for transmitting rotating power from the crankshaft to the camshaft, and means providing an enclosure surrounding the power transmission chain for containing lubricating oil, the invention is characterized by sealing means for preventing direct flow of oil from the crankshaft space and from the camshaft space into the chain enclosure.

Further objects, details and advantages of the invention will be apparent from the following detailed description, when read in conjunction with the drawings.

DETAILED DESCRIPTION

Figure 4:
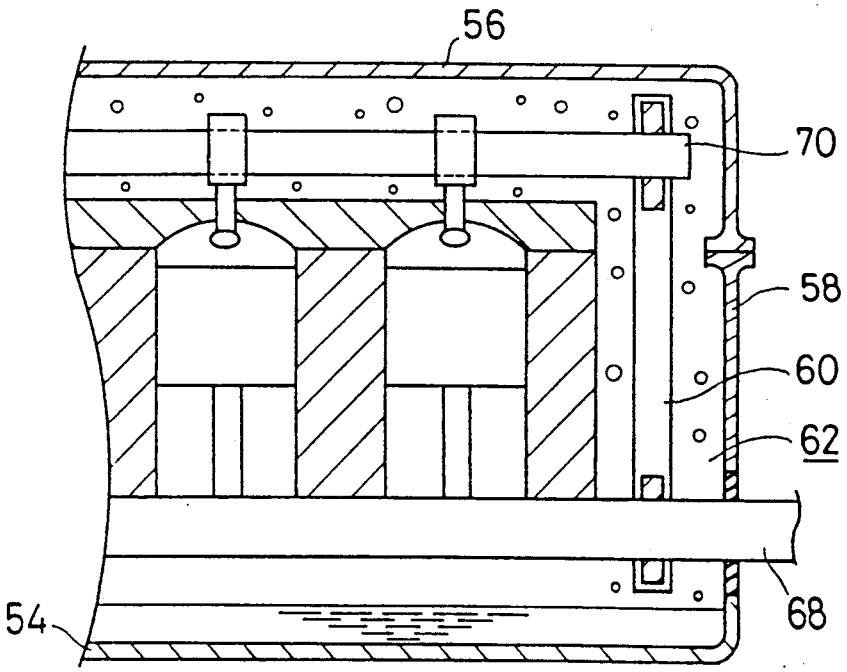
FIG. 4 PRIOR ART
FIG. 4 is a similar sectional view showing a conventional lubricating structure in accordance with the prior art.

Referring first to FIG. 4, which depicts an internal combustion engine having a conventional lubricating structure, lubrication essential to the operation of the engine is provided by lubricating oil contained in a continuous space 62 defined by the engine block, an oil pan 54, a cam cover 56 and a chain case 58.

The oil contained in space 62 is used to lubricate the various components of the engine including crankshaft 68, camshaft 70 and timing chain 60. As mentioned previously the oil is likely to deteriorate or contaminated at a rapid rate, resulting in early elongation and failure of timing chain 60.

Figure 1:
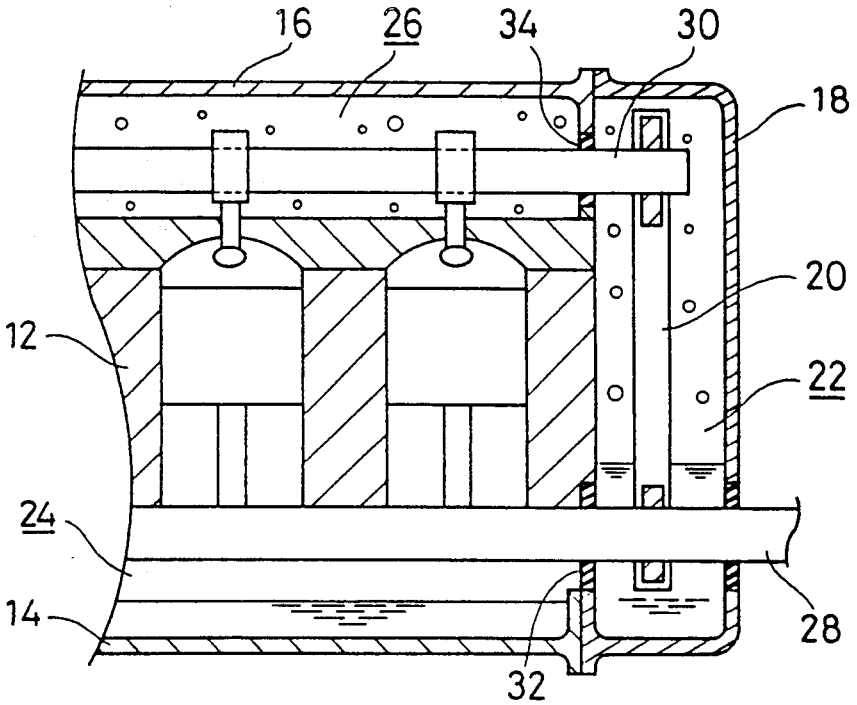
FIG. 1 is a sectional view through a portion of an internal combustion engine, showing a first embodiment of a lubricating structure according to the invention.

In the first embodiment of the invention, as shown in FIG. 1, a cylinder block 12 is provided with an oil pan 14, a cam cover 16, and a chain case 18. A timing chain 20 is installed in a space 22 within chain case 18. Space 22 is separated from a space 24, defined by the cylinder block 12 and the oil pan 14, and from a space 26 defined by cylinder block 12 and cam cover 16. A crankshaft 28 and a camshaft 30 extend into timing chain space 22. Oil seals 32 and 34, provided on shafts 28 and 30 respectively, maintain the timing chain space 22 oil-tight. In this embodiment, a quantity of lubricating oil for the timing chain is introduced into space 22, and remains in space 22. The oil within spaces 24 and 26 never mixes with the oil in space 22.

Figure 2:
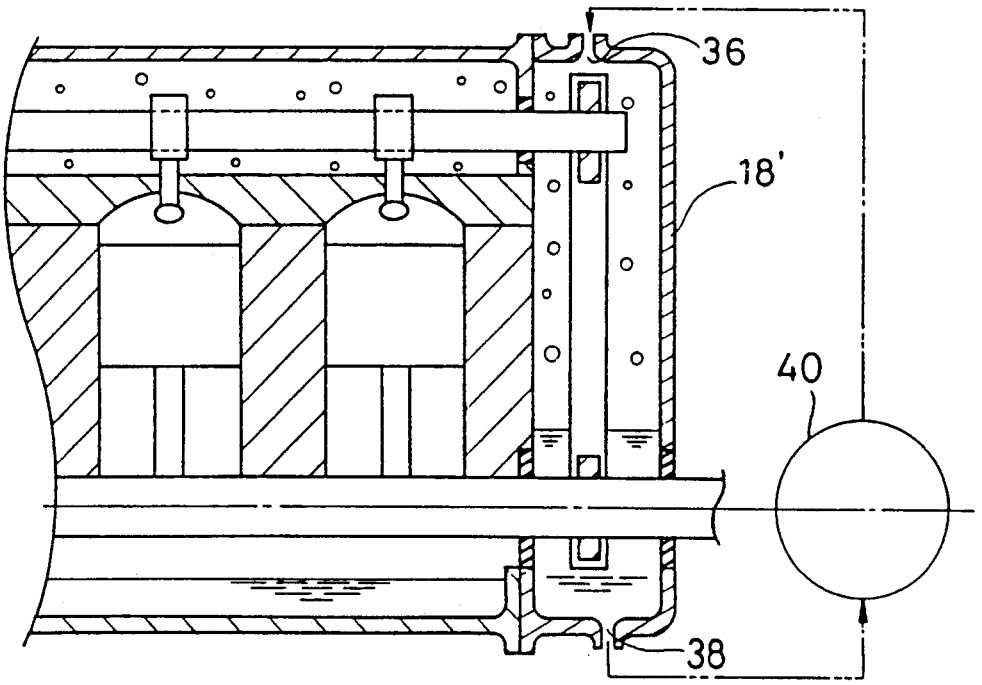
FIG. 2 is a similar sectional view showing a second embodiment of the invention.

The second embodiment, as shown in FIG. 2, is similar to the embodiment of FIG. 1, except that the lubricating oil for the timing chain is supplied by a circulating lubrication system. An oil supply port 36 is provided in the upper part of timing chain case 18' and an oil discharge port 38 is provided in the lower part of the case. An oil pump 40 is installed in an external recirculation path between the oil discharge port 38 and oil supply port 36. Oil pump 40 is preferably provided with a filter (not shown), through which the timing chain lubricating oil is circulated. Thus, in this embodiment, the timing chain is lubricated by a forced-feed lubrication system, which constantly supplies clean oil to the chain. Again, the oil within the camshaft and crankshaft spaces is prevented from mixing with the timing chain lubricating oil.

Figure 3:
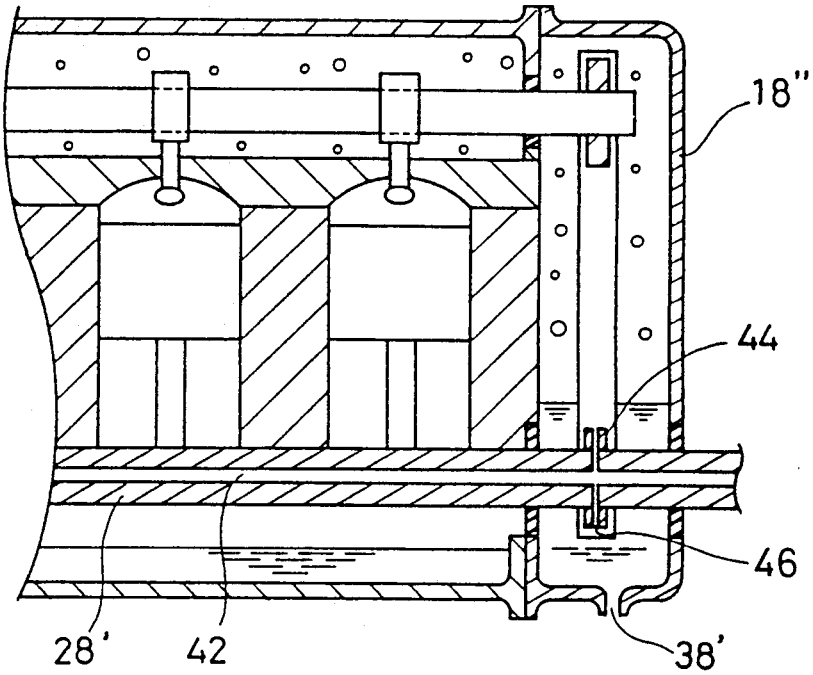
FIG. 3 is a similar sectional view showing a third embodiment invention.

In the embodiment of FIG. 3, again the timing chain enclosure is separated from the camshaft and crankshaft spaces. The crankshaft 28' is hollow, having and axially extending oil supply passage 42. This passage supplies oil under pressure to the piston bearings, and also to the timing chain space. A sprocket 44, fixed to the crankshaft and located on the crankshaft within the timing chain space, has an oil supply port 46 communicating with oil supply passage 42. The lower part of chain case 18'' is provided with an oil discharge port 38'. Filtered lubricating oil for the timing chain is supplied from the engine's oil pump, to the interior of chain case 18'', through the oil supply passage 42 in the crankshaft 28' and oil supply port 46 in the crankshaft sprocket 44. Direct flow of dirty oil from the crankshaft and camshaft spaces into the timing chain space is prevented. The lubricating structure of FIG. 3 is thus able to supply a clean oil constantly to the power transmission chain.

With the lubricating structures of the several embodiments described above with reference to FIGS. 1, 2 and 3, contamination and deterioration of the lubricating oil in contact with the chain is held to a minimum by preventing direct flow of oil used for lubricating other component parts into the timing chain space. Furthermore, since the space for mounting the chain can be kept oiltight, it is possible to use a special oil to lubricate the power transmission chain.

In automotive engines, particularly diesel engines and engines using leaded gasoline, the use of a quality chain is required in order to avoid chain elongation. With this invention, it is possible to realize the reduction of chain weight by maintaining good lubricating conditions.

While the invention has been described in the context of the lubrication of the timing chain of an internal combustion engine, it should be understood that the principles of the invention are applicable to the lubrication of various power transmission chains, including chains used in non-automotive machinery.

Various modifications other than those specifically described above can be made to the invention without departing from its scope as defined in the following claims.

We claim:

1. In an internal combustion engine having a crankshaft, at least one valve-operating camshaft, and means, comprising a chain, for transmitting rotating power from said crankshaft to each said valve-operating camshaft, and in which a part of the crankshaft is located within a space surrounding said part of the crankshaft and containing engine lubricating oil, and a part of each camshaft is also located within a space surrounding said part of each camshaft and containing said engine lubricating oil, means providing an enclosure surrounding said chain, said enclosure containing a quantity of chain lubricating oil, and sealing means preventing flow of said engine lubricating oil, other than through a filter, from said spaces into an interior of said enclosure, whereby contamination of the chain lubricating oil in said enclosure is prevented.

2. An internal combustion engine according to claim 1 in which said sealing means prevents flow of engine lubricating oil from said spaces into the interior of said enclosure.

3. An internal combustion engine according to claim 1 in which said crankshaft has means providing an internal passage extending along its axis of rotation for the flow of filtered engine lubricating oil, and including means providing an oil supply port, communicating with said internal passage, and permitting flow of said filtered engine lubricating oil from said internal passage into said enclosure surrounding the chain.

4. An internal combustion engine according to claim 1 having a sprocket on said crankshaft engaged with said chain in driving relationship, in which said crankshaft has means providing an internal passage extending along the axis of rotation of the crankshaft for flow of filtered engine lubricating oil, and in which said sprocket has an oil supply port communicating with said internal passage and permitting flow of said filtering engine lubricating oil from said internal passage, through said sprocket, into said enclosure surrounding the chain.

* * * * *